US008222824B2

(12) United States Patent
Yamane et al.

(10) Patent No.: US 8,222,824 B2
(45) Date of Patent: Jul. 17, 2012

(54) LIGHT EMITTING DIODE DRIVING APPARATUS

(75) Inventors: Mitsuru Yamane, Saitama (JP); Yoshiki Oyama, Kanagawa (JP)

(73) Assignee: Sony Corporation, Tokyo (JP)

( * ) Notice: Subject to any disclaimer, the term of this patent is extended or adjusted under 35 U.S.C. 154(b) by 425 days.

(21) Appl. No.: 12/537,761

(22) Filed: Aug. 7, 2009

(65) Prior Publication Data

US 2010/0039037 A1 Feb. 18, 2010

(30) Foreign Application Priority Data

Aug. 13, 2008 (JP) ..... P2008-208697

(51) Int. Cl.
*H05B 37/02* (2006.01)

(52) U.S. Cl. ..... 315/185 R; 315/307

(58) Field of Classification Search ..... 315/185 R, 315/187, 294, 307, 297
See application file for complete search history.

(56) References Cited

U.S. PATENT DOCUMENTS 6,369,525 B1 * 4/2002 Chang et al. ..... 315/300
7,408,308 B2 * 8/2008 Sawada et al. ..... 315/291
2006/0255753 A1 * 11/2006 Sawada et al. ..... 315/312
2009/0267521 A1 10/2009 Jin

FOREIGN PATENT DOCUMENTS

| | | |
|---|---|---|
| JP | 2004-335443 | 11/2004 |
| JP | 2006-319221 | 11/2006 |
| JP | 2006-352116 | 12/2006 |
| JP | 2007-507855 | 3/2007 |
| JP | 2008-152101 | 7/2008 |

* cited by examiner

*Primary Examiner* — Daniel D Chang
(74) *Attorney, Agent, or Firm* — Finnegan Henderson Farabow Garrett & Dunner LLP

(57) ABSTRACT

A light emitting diode driving apparatus includes: a switching converter having an inductor and a switching device; a plurality of serial light emitting diode lines each having a plurality of light emitting diodes connected in series; a plurality of rectifier diodes respectively connected in series to the plurality of serial light emitting diode lines; a plurality of capacitors respectively connected to nodes between the serial light emitting diode lines and the rectifier diodes for smoothing a voltage; and one or more current distribution coils disposed between the switching converter and the plurality of serial light emitting diode lines to let a current flow in a direction of canceling out a magnetic flux generated by a first winding and a magnetic flux generated by a second winding each other, thereby making currents flowing in the serial light emitting diode lines equal to each other.

3 Claims, 3 Drawing Sheets

LIGHT EMITTING DIODE DRIVING APPARATUS

BACKGROUND OF THE INVENTION

1. Field of the Invention

The present invention relates to a light emitting diode driving apparatus.

2. Description of the Related Art

Recently, liquid crystal devices using liquid crystals are widely used in a variety of industrial fields. Such a liquid crystal device employs a structure where a backlight device is provided on the back side of a liquid crystal panel to irradiate light to the liquid crystal panel. In the past, a cold cathode fluorescent tube (CCFL) is frequently used as a backlight device. In the recent years, however, light emitting diodes (LEDs) are used as well. In case of using light emitting diodes, the light emitting diodes are connected in series, and a favorable drive voltage is applied across a plurality of light emitting diodes connected in series. Further, there is a technique of arranging plural lines of light emitting diodes connected in series to cause the light emitting diodes to emit light over a wide area.

An example of the related art includes JP-A-2008-152101.

SUMMARY OF THE INVENTION

However, the forward bias voltage of a light emitting diode (hereinafter called "voltage Vf") varies greatly, so that even light emitting diodes of the same kind have a difference in voltage Vf. In case where light emitting diodes are driven on a constant controlled voltage, therefore, a large current flows when the voltage Vf is low, and a small current flows when the voltage Vf is high, so that the luminance of light obtained from the backlight device does not become constant. To control the luminance without being influenced by a variation in voltage Vf, a technique of driving light emitting diodes on a constant current has been employed. In the past, one constant current control circuit is used for a line of light emitting diodes connected in series. Therefore, driving multiple lines of light emitting diodes needs drive circuits each formed as a constant current control circuit, which are equal in number to the lines. A low-cost series regulator type control circuit with a small circuit scale suffers a large power loss originating from the difference between the supply voltage and a voltage Vfs (which is the sum of the individual voltages Vf of a plurality of light emitting diodes connected in series). When a switching regulator type control circuit which has a small power loss is used, it has a large circuit scale, thus bringing about a problem such that the mounting area becomes larger and the cost for the circuit becomes higher.

Thus, it is desirable to provide a light emitting diode driving apparatus at a low circuit cost, which can let an equal current flow to individual light emitting diodes in multiple lines of light emitting diodes.

A light emitting diode driving apparatus according to an embodiment of the present invention includes a switching converter having an inductor and a switching device; a plurality of serial light emitting diode lines each having a plurality of light emitting diodes connected in series; a plurality of rectifier diodes respectively connected in series to the plurality of serial light emitting diode lines; a plurality of capacitors respectively connected to nodes between the serial light emitting diode lines and the rectifier diodes for smoothing a voltage; and one or more current distribution coils disposed between the switching converter and the plurality of serial light emitting diode lines to let a current flow in a direction of canceling out a magnetic flux generated by a first winding and a magnetic flux generated by a second winding each other, thereby making currents flowing in the serial light emitting diode lines equal to each other.

The light emitting diode driving apparatus according to the embodiment of the present invention may have one or more current distribution coils disposed between the switching converter and the plurality of serial light emitting diode lines to let the current flow in the direction of canceling out a magnetic flux generated by the first winding and a magnetic flux generated by the second winding each other. This makes the currents flowing in the serial light emitting diode lines equal to each other.

The embodiment of the present invention can provide a light emitting diode driving apparatus that has one or more current distribution coils disposed between the switching converter and the plurality of serial light emitting diode lines to let the current flow in the direction of canceling out a magnetic flux generated by the first winding and a magnetic flux generated by the second winding each other, so that an equal current can flow in each of multiple lines of light emitting diodes.

DETAILED DESCRIPTION OF THE PREFERRED EMBODIMENTS

A light emitting diode driving apparatus according to a best mode for carrying out the invention includes a switching converter having an inductor and a switching device. The light emitting diode driving apparatus has a plurality of serial light emitting diode lines each having a plurality of light emitting diodes connected in series. The light emitting diode driving apparatus has a plurality of rectifier diodes respectively connected in series to the plurality of serial light emitting diode lines. The light emitting diode driving apparatus has a plurality of capacitors respectively connected to nodes between the serial light emitting diode lines and the rectifier diodes for smoothing a voltage. The light emitting diode driving apparatus has one or more current distribution coils disposed between the switching converter and the plurality of serial light emitting diode lines. The current distribution coil allows a current to flow in the direction of canceling out a magnetic flux generated by the first winding of the current distribution coil and a magnetic flux generated by the second winding thereof each other, thereby making currents flowing in the serial light emitting diode lines equal to each other. Preferred embodiments is described below with reference to the accompanying drawings.

Figure 1:
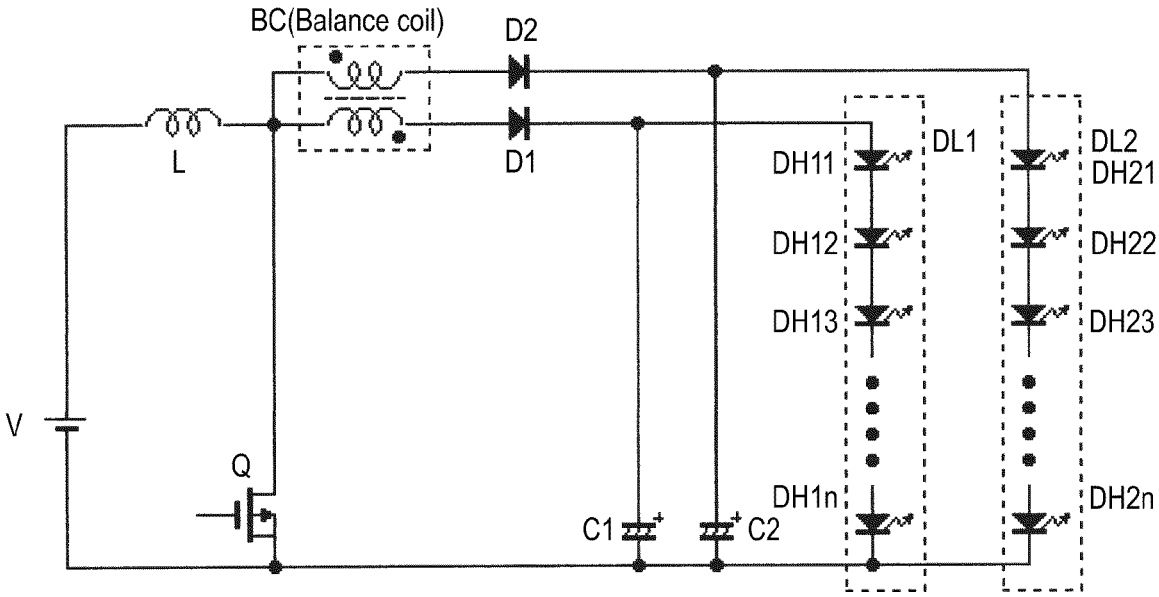
FIG. 1 is a diagram showing a light emitting diode driving apparatus according to a first embodiment which drives a first serial light emitting diode line and a second serial light emitting diode line.

FIG. 1 is a diagram showing a light emitting diode driving apparatus according to a first embodiment which drives a first serial light emitting diode line and a second serial light emitting diode line. Referring to FIG. 1, a first embodiment is described.

A serial light emitting diode line DL1 (first serial light emitting diode line) is connected to a node between the cathode of a rectifier diode D1 (first rectifier diode) and the positive terminal of a capacitor C1 (first capacitor). The serial light emitting diode line DL1 has light emitting diodes DH11 to DH1*n* connected in series in order in such a way that the cathode of the light emitting diode DH11 is connected to the anode of the light emitting diode DH12, the cathode of the light emitting diode DH12 is connected to the anode of the light emitting diode DH13, and so forth to the light emitting diode DH1*n*. In the embodiment, for example, n=10 and ten light emitting diodes are connected in series. The cathode of the light emitting diode DH1*n* is connected to the negative terminal of the capacitor C1.

A serial light emitting diode line DL2 (second serial light emitting diode line) is connected to a node between the cathode of a rectifier diode D2 (second rectifier diode) and the positive terminal of a capacitor C2 (second capacitor). The serial light emitting diode line DL2 has light emitting diodes DH21 to DH2*n* connected in series in order in such a way that the cathode of the light emitting diode DH21 is connected to the anode of the light emitting diode DH22, the cathode of the light emitting diode DH22 is connected to the anode of the light emitting diode DH23, and so forth to the light emitting diode DH2*n*. In the embodiment, for example, n=10 and ten light emitting diodes are connected in series as in the serial light emitting diode line DL1. The cathode of the light emitting diode DH2*n* is connected to the negative terminal of the capacitor C2. The anode of the rectifier diode D1 is connected to one winding of a current distribution coil (Balance Coil) BC, while the anode of the rectifier diode D2 is connected to the other winding of the current distribution coil BC.

The current distribution coil BC has a first winding (upper winding in FIG. 1) and a second winding (lower winding in FIG. 1). The first winding and the second winding are wound on the same core. The number of turns of the first winding is set equal to the number of turns of the second winding. The mark "•" affixed to each of the first winding and the second winding is a symbol indicative of the start of turning. The first and second windings have large inductance components, and both windings are wound densely in the direction of canceling out internal magnetic fluxes. As shown in FIG. 1, the start of turning of the first winding is connected to the end of turning of the second winding, a node therebetween is connected to a node between an inductor L and a switching device Q, the rectifier diode D1 is connected to the start of turning of the second winding, and the rectifier diode D2 is connected to the end of turning of the first winding. The inductor L and the switching device Q constitute a boost converter. The expression "both windings are wound densely in the direction of canceling out internal magnetic fluxes" should not necessarily mean that the winding directions of the windings are limited. The expression means that the current distribution coil is used in such a way that the currents flowing in the two windings of the current distribution coil flow in the directions of canceling out the magnetic fluxes generated.

The action of the current distribution coil BC equally divides the current output from the boost converter into two components which pass the rectifier diode D1 and the rectifier diode D2, respectively charging the capacitor C1 and the capacitor C2. The charge current for the capacitor C1 is a current $ic_1$, and a voltage across the capacitor C1 boosted by the current $ic_1$ is a voltage $\Delta V1_1$. A current to be supplied to the serial light emitting diode line DL1 from the capacitor C1 is a current $i_{led1}$, the capacitance of the capacitor C1 is a capacitance C1, a voltage across the capacitor C1 which is dropped by the current $i_{led1}$ is a voltage $\Delta V1_2$. The following equations 1 and 2 are satisfied for the voltage $\Delta V1_1$ and the voltage $\Delta V1_2$. The capacitor C1 functions as a smoothing capacitor to smoothen the voltage.

$$\Delta V1_1 = \frac{1}{C1}\int ic_1 dt \qquad \text{Equation 1}$$

$$\Delta V1_2 = \frac{1}{C1}\int i_{led1} dt \qquad \text{Equation 2}$$

In the steady state, $\Delta V1_1$ and $\Delta V1_2$ are equal to each other.

Likewise, the charge current for the capacitor C2 is a current $ic_2$, and a voltage across the capacitor C2 boosted by the current $ic_2$ is a voltage $\Delta V2_1$. A current to be supplied to the serial light emitting diode line DL2 from the capacitor C2 is a current $i_{led2}$, the capacitance of the capacitor C2 is a capacitance C2, a voltage across the capacitor C2 which is dropped by the current $i_{led2}$ is a voltage $\Delta V2_2$. The following equations 3 and 4 are satisfied for the voltage $\Delta V2_1$ and the voltage $\Delta V2_2$. The capacitor C2 functions as a smoothing capacitor to smoothen the voltage.

$$\Delta V2_1 = \frac{1}{C2}\int ic_2 dt \qquad \text{Equation 3}$$

$$\Delta V2_2 = \frac{1}{C2}\int i_{led2} dt \qquad \text{Equation 4}$$

In the steady state, $\Delta V2_1$ and $\Delta V2_2$ are equal to each other.

At this time, the current $ic_1$ and the current $ic_2$ can be distributed equally and evenly by the action of the current distribution coil BC, thus making it possible to evenly set the current $i_{led1}$ flowing in the serial light emitting diode line DL1 and the current $i_{led2}$ flowing in the serial light emitting diode line DL2. In this manner, the sum of the individual voltages Vf (whose values vary from one light emitting diode from another) in the light emitting diodes DH11 to DH1*n* which form the serial light emitting diode line DL1 is given by a voltage $Vfs_1$. The sum of the individual voltages Vf in the light emitting diodes DH21 to DH2*n* which form the serial light emitting diode line DL2 is given by a voltage $Vfs_2$. Even when the voltage $Vfs_1$ and the voltage $Vfs_2$ differ from each other, the current distribution coil BC can make the current $i_{led1}$ and the current $i_{led2}$ equal to each other.

That is, the light emitting diode driving apparatus according to the first embodiment has a single current distribution coil BC whose first and second windings have one ends connected to the switching converter. Here, one end of the first winding is the start of turning, and one end of the second winding is the end of turning. That is, the first winding and the second winding may be changed from one to the other as long as both windings are connected in such a way as to cancel out magnetic fluxes each other when the current is let to flow from one end of the first winding and the current is let to flow from one end of the second winding. The expression "other end" means a side different from the one end. The meanings of the expressions "one end" and "other end" are the same in the following description.

The light emitting diode driving apparatus has the serial light emitting diode line DL1 (first serial light emitting diode line) connected to the other end of the first winding of the current distribution coil BC via the rectifier diode D1 (first rectifier diode). The light emitting diode driving apparatus has the serial light emitting diode line DL2 (second serial light emitting diode line) connected to the other end of the second winding of the current distribution coil BC via the rectifier diode D2 (second rectifier diode). The values of the currents flowing in the two serial light emitting diode lines are made equal to each other in this manner. The foregoing description of the first embodiment has been given on the assumption that a positive voltage is obtained at the node between the capacitor C1 and the rectifier diode D1 and the node between the capacitor C2 and the rectifier diode D2. However, similar effects are acquired even if the circuit is operated in the reverse polarity with the whole polarities of the circuit (the polarity of a supply voltage V, the polarity of the switching converter, the polarity of the rectifier diode, the polarity of the capacitor and the polarity of the serial light emitting diode line) are changed. The same can be said to the changing of the polarities in second to seventh embodiments to be described below.

Figure 2:
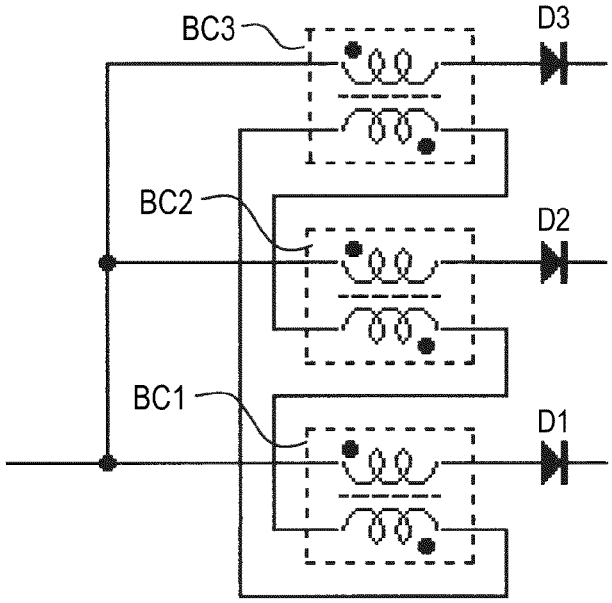
FIG. 2 is a diagram showing the essential portions of a light emitting diode driving apparatus according to a second embodiment which drives a first serial light emitting diode line, a second serial light emitting diode line and a third serial light emitting diode line.

FIG. 2 is a diagram showing the essential portions of a light emitting diode driving apparatus according to the second embodiment which drives a first serial light emitting diode line, a second serial light emitting diode line and a third serial light emitting diode line. Referring to FIG. 2, the second embodiment is described.

A current distribution coil BC1 (first current distribution coil), a current distribution coil BC2 (second current distribution coil), and a current distribution coil BC3 (third current distribution coil) shown in FIG. 2 have the same structures as that of the current distribution coil BC in the first embodiment. The second windings of the current distribution coils BC1 to BC3 are connected in series in a ring shape. The expression "connected in series in a ring shape" means the following connection. The end of turning of the second winding of the current distribution coil BC1 is connected to the start of turning of the second winding of the current distribution coil BC2. The end of turning of the second winding of the current distribution coil BC2 is connected to the start of turning of the second winding of the current distribution coil BC3. The end of turning of the second winding of the current distribution coil BC3 is connected to the start of turning of the second winding of the current distribution coil BC1. The first windings of the current distribution coils BC1 to BC3 are connected to one another at their turning start points.

The first windings of the current distribution coils BC1 to BC3 which are connected to one another are connected to the node between the inductor L and the switching device Q as shown in FIG. 1. The end of turning of the first winding of the current distribution coil BC1 is connected to the anode of the rectifier diode D1. The end of turning of the first winding of the current distribution coil BC2 is connected to the anode of the rectifier diode D2, and the end of turning of the first winding of the current distribution coil BC3 is connected to the anode of the rectifier diode D3.

Though not illustrated in FIG. 2, the cathode of the rectifier diode D1 is connected to the node between the positive terminal of the capacitor C1 and the anode of the serial light emitting diode line DL1 as shown in FIG. 1. The negative terminal of the capacitor C1 is connected to the cathode of the serial light emitting diode line DL1. Likewise, though not illustrated in FIG. 2, the cathode of the rectifier diode D2 is connected to the node between the positive terminal of the capacitor C2 and the anode of the serial light emitting diode line DL2 as shown in FIG. 1. The negative terminal of the capacitor C2 is connected to the cathode of the serial light emitting diode line DL2. Likewise, the cathode of the rectifier diode D3 is connected to the node between the positive terminal of a capacitor C3 (not shown) and the anode of the serial light emitting diode line DL3 (not shown) as shown in FIG. 1. The negative terminal of the capacitor C3 is connected to the cathode of the serial light emitting diode line DL3.

In this manner, the voltage boosted by the boost converter is supplied to the rectifier diodes D1 to D3 via the current distribution coils BC1 to BC3. This can make the current $i_{led1}$ flowing in the serial light emitting diode line DL1, the current $i_{led2}$ flowing in the serial light emitting diode line DL2, and a current $i_{led3}$ flowing in the serial light emitting diode line DL3 equal to one another. That is, the whole current can be separated into equal ⅓ current components. In other words, the actions of the current distribution coils BC1 to BC3 can allow the same current to flow to the serial light emitting diode lines DL1 to DL3 even if the voltage $Vfs_1$ of the serial light emitting diode line DL1, the voltage $Vfs_2$ of the serial light emitting diode line DL2, and a voltage $Vfs_3$ of the serial light emitting diode line DL3 differ from one another.

According to the second embodiment, one end of the first winding of the current distribution coil BC1 (first current distribution coil), one end of the first winding of the current distribution coil BC2 (second current distribution coil), and one end of the first winding of the current distribution coil BC3 (third current distribution coil) are connected to one another. The node of the mutual connection is connected to the switching converter. Here, the expression "one end" does not mean that it is specified to be one of the start of turning of the winding and the end of turning of the winding. It is to be noted that the winding directions of the first winding and the second winding of the same current distribution coil in the current distribution coils BC1 to BC3 are important. For example, even if the directions of the start of turning and the end of turning of both the first and second windings of each current distribution coil are changed from one to the other, the currents flow in the first and second windings in such a way as to cancel the magnetic fluxes generated in each current distribution coil, thereby bringing about similar effects.

The second winding of the current distribution coil BC1, the second winding of the current distribution coil BC2, and the second winding of the current distribution coil BC3 are connected in a ring shape. The expression "in a ring shape" means that the second windings of the three current distribution coils are connected in series so that the currents flow in the individual second windings of the individual current distribution coils. It is needless to say that in a case of making such connection, the windings are connected with the polarities in such a way as to cancel out the magnetic fluxes generated. The light emitting diode driving apparatus has the serial light emitting diode line DL1 (first serial light emitting diode line) connected to the other end of the first winding of the current distribution coil BC1 via the rectifier diode D1 (first rectifier diode). The light emitting diode driving apparatus has the serial light emitting diode line DL2 (second serial light emitting diode line) connected to the other end of the first winding of the current distribution coil BC2 via the rectifier diode D2 (second rectifier diode). The light emitting diode driving apparatus has the serial light emitting diode line DL3 (third serial light emitting diode line) connected to the other end of the first winding of the current distribution coil BC3 via the rectifier diode D3 (third rectifier diode).

Figure 3:
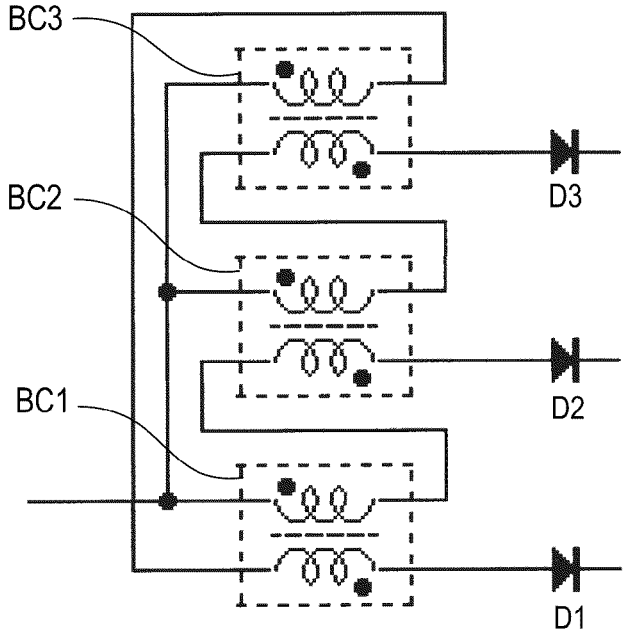
FIG. 3 is a diagram showing the essential portions of a light emitting diode driving apparatus according to a third embodiment which drives a first serial light emitting diode line, a second serial light emitting diode line and a third serial light emitting diode line.

FIG. 3 is a diagram showing the essential portions of a light emitting diode driving apparatus according to the third embodiment which drives a first serial light emitting diode line, a second serial light emitting diode line and a third serial light emitting diode line. Referring to FIG. 3, the third embodiment is described.

A current distribution coil BC1 (first current distribution coil), a current distribution coil BC2 (second current distribution coil), and a current distribution coil BC3 (third current distribution coil) shown in FIG. 3 have the same structures as that of the current distribution coil BC in the first embodiment. The first windings of the current distribution coils BC1 to BC3 are connected to one another at their turning start points. The end of turning of the first winding of the current distribution coil BC1 is connected to the end of turning of the second winding of the current distribution coil BC2. The end of turning of the first winding of the current distribution coil BC2 is connected to the end of turning of the second winding of the current distribution coil BC3. The end of turning of the first winding of the current distribution coil BC3 is connected to the end of turning of the second winding of the current distribution coil BC1. The first windings of the current distribution coils BC1 to BC3 which are connected to one another are connected to the node between the inductor L and the switching device Q as shown in FIG. 1.

The start of turning of the second winding of the current distribution coil BC1 is connected to the anode of the rectifier diode D1. The start of turning of the second winding of the current distribution coil BC2 is connected to the anode of the rectifier diode D2. The start of turning of the second winding of the current distribution coil BC3 is connected to the anode of the rectifier diode D3.

Though not illustrated in FIG. 2, the cathode of the rectifier diode D1 is connected to the node between the positive terminal of the capacitor C1 and the anode of the serial light emitting diode line DL1 as shown in FIG. 1. The negative terminal of the capacitor C1 is connected to the cathode of the serial light emitting diode line DL1. Likewise, though not illustrated in FIG. 2, the cathode of the rectifier diode D2 is connected to the node between the positive terminal of the capacitor C2 and the anode of the serial light emitting diode line DL2 as shown in FIG. 1. The negative terminal of the capacitor C2 is connected to the cathode of the serial light emitting diode line DL2. Likewise, the cathode of the rectifier diode D3 is connected to the node between the positive terminal of a capacitor C3 (not shown) and the anode of the serial light emitting diode line DL3 (not shown) as shown in FIG. 1. The negative terminal of the capacitor C3 is connected to the cathode of the serial light emitting diode line DL3.

In this manner, the voltage boosted by the boost converter is supplied to the rectifier diodes D1 to D3 via the current distribution coils BC1 to BC3. This can make the current $i_{led1}$ flowing in the serial light emitting diode line DL1, the current $i_{led2}$ flowing in the serial light emitting diode line DL2, and the current $i_{led3}$ flowing in the serial light emitting diode line DL3 equal to one another, i.e., ⅓ of the whole current. In other words, the actions of the current distribution coils BC1 to BC3 can allow the same current to flow to the serial light emitting diode lines DL1 to DL3 even if the voltage $Vfs_1$ of the serial light emitting diode line DL1, the voltage $Vfs_2$ of the serial light emitting diode line DL2, and the voltage $Vfs_3$ of the serial light emitting diode line DL3 differ from one another.

According to the third embodiment, one end of the first winding of the current distribution coil BC1 (first current distribution coil), one end of the first winding of the current distribution coil BC2 (second current distribution coil), and one end of the first winding of the current distribution coil BC3 (third current distribution coil) are connected to one another. The node of the mutual connection is connected to the switching converter. Further, the other end of the first winding of the current distribution coil BC1 is connected to one end of the second winding of the current distribution coil BC2. Moreover, the other end of the first winding of the current distribution coil BC2 is connected to one end of the second winding of the current distribution coil BC3. The other end of the first winding of the current distribution coil BC3 is connected to one end of the second winding of the current distribution coil BC1. This connection allows the magnetic fluxes generated in the current distribution coil BC1 to cancel out each other, making the current flowing in the first winding equal to the current flowing in the second winding. In addition, the connection allows the magnetic fluxes generated in the current distribution coil BC2 to cancel out each other, making the current flowing in the first winding equal to the current flowing in the second winding. Moreover, the connection allows the magnetic fluxes generated in the current distribution coil BC3 to cancel out each other, making the current flowing in the first winding equal to the current flowing in the second winding.

The light emitting diode driving apparatus has the serial light emitting diode line DL1 (first serial light emitting diode line) connected to the other end of the first winding of the current distribution coil BC1 via the rectifier diode D1 (first rectifier diode). The light emitting diode driving apparatus has the serial light emitting diode line DL2 (second serial light emitting diode line) connected to the other end of the first winding of the current distribution coil BC2 via the rectifier diode D2 (second rectifier diode). The light emitting diode driving apparatus has the serial light emitting diode line DL3 (third serial light emitting diode line) connected to the other end of the first winding of the current distribution coil BC3 via the rectifier diode D3 (third rectifier diode).

Figure 4:
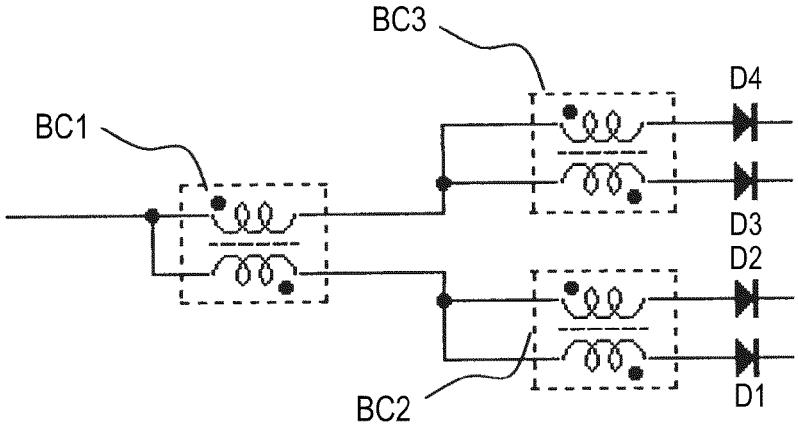
FIG. 4 is a diagram showing the essential portions of a light emitting diode driving apparatus according to a fourth embodiment which drives a first serial light emitting diode line, a second serial light emitting diode line, a third serial light emitting diode line and a fourth serial light emitting diode line.

FIG. 4 is a diagram showing the essential portions of a light emitting diode driving apparatus according to the fourth embodiment which drives a first serial light emitting diode line, a second serial light emitting diode line, a third serial light emitting diode line and a fourth serial light emitting diode line. Referring to FIG. 4, the fourth embodiment is described.

A current distribution coil BC1 (first current distribution coil), a current distribution coil BC2 (second current distribution coil), and a current distribution coil BC3 (third current distribution coil) shown in FIG. 4 have the same structures as that of the current distribution coil BC in the first embodiment. The end of turning of the second winding of each of the current distribution coils BC1 to BC3 is connected to the start of turning of the first winding of that current distribution coil. The start of turning of the second winding of the current distribution coil BC1 is connected to the node between the end of turning of the second winding of the current distribution coil BC2 and the start of turning of the first winding thereof. The end of turning of the first winding of the current distribution coil BC1 is connected to the node between the end of turning of the second winding of the current distribution coil BC3 and the start of turning of the first winding thereof. The anode of the rectifier diode D1 is connected to the start of turning of the second winding of the current distribution coil BC2, and the anode of the rectifier diode D2 is connected to the end of turning of the first winding of the current distribution coil BC2. The anode of the rectifier diode D3 is connected to the start of turning of the second winding of the current distribution coil BC3, and the anode of the rectifier diode D4 is connected to the end of turning of the first winding of the current distribution coil BC3. The node between the first and second windings of the current distribution coil BC1 is connected to the node between the inductor L and the switching device Q as shown in FIG. 1.

Though not illustrated in FIG. 2, the cathode of the rectifier diode D1 is connected to the node between the positive terminal of the capacitor C1 and the anode of the serial light emitting diode line DL1 as shown in FIG. 1. The negative terminal of the capacitor C1 is connected to the cathode of the serial light emitting diode line DL1. Likewise, though not illustrated in FIG. 2, the cathode of the rectifier diode D2 is connected to the node between the positive terminal of the capacitor C2 and the anode of the serial light emitting diode line DL2 as shown in FIG. 1. The negative terminal of the capacitor C2 is connected to the cathode of the serial light emitting diode line DL2. Likewise, the cathode of the rectifier diode D3 is connected to the node between the positive terminal of a capacitor C3 (not shown) and the anode of the serial light emitting diode line DL3 (not shown). The negative terminal of the capacitor C3 is connected to the cathode of the serial light emitting diode line DL3. Further, the cathode of the rectifier diode D4 (not shown) is connected to the node between the positive terminal of a capacitor C4 (not shown) and the anode of an unillustrated serial light emitting diode line DL4 (fourth serial light emitting diode line). The negative terminal of the capacitor C4 is connected to the cathode of the serial light emitting diode line DL4.

In this manner, the voltage boosted by the boost converter is supplied to the rectifier diodes D1 to D3 via the current distribution coils BC1 to BC3. This can make the current $i_{led1}$ flowing in the serial light emitting diode line DL1, the current $i_{led2}$ flowing in the serial light emitting diode line DL2, the current $i_{led3}$ flowing in the serial light emitting diode line DL3, and a current $i_{led4}$ flowing in the serial light emitting diode line DL4 equal to one another, i.e., ¼ of the whole current. In other words, the actions of the current distribution coils BC1 to BC3 can allow the same current to flow to the serial light emitting diode lines DL1 to DL4 even if the voltage $Vfs_1$ of the serial light emitting diode line DL1, the voltage $Vfs_2$ of the serial light emitting diode line DL2, the voltage $Vfs_3$ the serial light emitting diode line DL3 and a voltage $Vfs_4$ of the serial light emitting diode line DL4 differ from one another.

In other words, according to the fourth embodiment, one end of the first winding of the current distribution coil BC1 (first current distribution coil) and one end of the second winding thereof are connected to the switching converter. Further, one end of the first winding of the current distribution coil BC2 (second current distribution coil) and one end of the second winding thereof are connected to the other end of the second winding of the current distribution coil BC1. Moreover, one end of the first winding of the current distribution coil BC3 (third current distribution coil) and one end of the second winding thereof are connected to the other end of the first winding of the current distribution coil BC1. That is, the light emitting diode driving apparatus has three current distribution coils connected in the above manner. This connection allows the magnetic fluxes generated in the current distribution coil BC1 to cancel out each other, making the current flowing in the first winding equal to the current flowing in the second winding. In addition, the connection allows the magnetic fluxes generated in the current distribution coil BC2 to cancel out each other, making the current flowing in the first winding equal to the current flowing in the second winding. Moreover, the connection allows the magnetic fluxes generated in the current distribution coil BC3 to cancel out each other, making the current flowing in the first winding equal to the current flowing in the second winding.

The light emitting diode driving apparatus has the serial light emitting diode line DL1 (first serial light emitting diode line) connected to the other end of the second winding of the current distribution coil BC2 via the rectifier diode D1 (first rectifier diode). The light emitting diode driving apparatus has the serial light emitting diode line DL2 (second serial light emitting diode line) connected to the other end of the first winding of the current distribution coil BC2 via the rectifier diode D2 (second rectifier diode). The light emitting diode driving apparatus has the serial light emitting diode line DL3 (third serial light emitting diode line) connected to the other end of the second winding of the current distribution coil BC3 via the rectifier diode D3 (third rectifier diode). The light emitting diode driving apparatus has the serial light emitting diode line DL4 (fourth serial light emitting diode line) connected to the other end of the first winding of the current distribution coil BC3 via the rectifier diode D4 (fourth rectifier diode).

Figure 5:
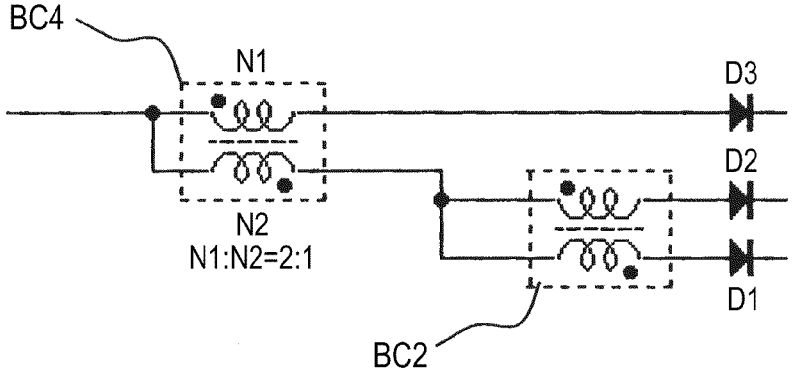
FIG. 5 is a diagram showing the essential portions of a light emitting diode driving apparatus according to a fifth embodiment which drives a first serial light emitting diode line, a second serial light emitting diode line, a third serial light emitting diode line and a fourth serial light emitting diode line.

FIG. 5 is a diagram showing the essential portions of a light emitting diode driving apparatus according to the fifth embodiment which drives a first serial light emitting diode line, a second serial light emitting diode line, a third serial light emitting diode line and a fourth serial light emitting diode line. Referring to FIG. 5, the fifth embodiment is described.

As shown in FIG. 5, the end of turning of the second winding of the current distribution coil BC4 (fourth current distribution coil) and the start of turning of the first winding thereof are connected to each other. The start of turning of the second winding of the current distribution coil BC4 is connected to the node between the end of turning of the second winding of the current distribution coil BC2 and the start of turning of the first winding thereof, the anode of the rectifier diode D2 is connected to the end of turning of the first winding of the current distribution coil BC2 (second current distribution coil), the anode of the rectifier diode D1 is connected to the start of turning of the second winding of the current distribution coil BC2, and the anode of the rectifier diode D3 is connected to the end of turning of the first winding of the current distribution coil BC4. The current distribution coil BC2 has the same structure as the current distribution coil BC in the first embodiment. The number of turns of the first winding N1 of the current distribution coil BC4 is set to a turn number $N_1$, and the number of turns of the second winding N2 thereof is set to a turn number $N_2$. Here, $N_1:N_2=2:1$.

As the ratio of the turn number $N_1$ of the current distribution coil BC4 to the turn number $N_2$ thereof is set to the above ratio, the current distribution coil BC4 acts to adjust the current in such a way that (current flowing in the first winding N1 having the turn number $N_1$):(current flowing in the second winding N2 having the turn number $N_2$)=1:2. Because the number of turns of the first winding of the current distribution coil BC2 is equal to the number of turns of the second winding thereof, the current flowing in the first winding of the current distribution coil BC2 becomes equal to the current flowing in the second winding thereof. Therefore, the current flowing in the first winding N1 of the current distribution coil BC4, the current flowing in the first winding of the current distribution coil BC2, and the current flowing in the second winding of the current distribution coil BC2 become equal to one another.

Though not illustrated in FIG. 5, the cathode of the rectifier diode D1 is connected to the node between the positive terminal of the capacitor C1 and the anode of the serial light emitting diode line DL1 as shown in FIG. 1. The negative terminal of the capacitor C1 is connected to the cathode of the serial light emitting diode line DL1. Likewise, though not illustrated in FIG. 2, the cathode of the rectifier diode D2 is connected to the node between the positive terminal of the capacitor C2 and the anode of the serial light emitting diode line DL2 as shown in FIG. 1. The negative terminal of the capacitor C2 is connected to the cathode of the serial light emitting diode line DL2. Likewise, the cathode of the rectifier diode D3 is connected to the node between the positive terminal of a capacitor C3 and the anode of the serial light emitting diode line DL3. The negative terminal of the capacitor C3 is connected to the cathode of the serial light emitting diode line DL3. Further, the node between the end of turning of the second winding of the current distribution coil BC4 and the start of turning of the first winding thereof is connected to the node between the inductor L and the switching device Q as shown in FIG. 1.

In this manner, the voltage boosted by the boost converter is supplied to the rectifier diodes D1 to D4 via the current distribution coils BC1 to BC3. This can make the current $i_{led1}$ flowing in the serial light emitting diode line DL1, the current $i_{led2}$ flowing in the serial light emitting diode line DL2, and the current $i_{led3}$ flowing in the serial light emitting diode line DL3 equal to one another, i.e., ⅓ of the whole current. That is, the actions of the current distribution coils BC2 and BC4 can allow the same current to flow to the serial light emitting diode lines DL1 to DL3 even if the voltage $Vfs_1$ of the serial light emitting diode line DL1, the voltage $Vfs_2$ of the serial light emitting diode line DL2, and the voltage $Vfs_3$ of the serial light emitting diode line DL3 differ from one another.

The light emitting diode driving apparatus has two current distribution coils in such a way that one end of the first winding and one end of the second winding of the current distribution coil BC4 (fourth current distribution coil) which is formed in such a way that the number of turns of the first winding becomes double the number of turns of the second winding are connected to the switching converter, and one end of the first winding and one end of the second winding of the current distribution coil BC2 (second current distribution coil) are connected to the other end of the second winding of the current distribution coil BC4. The light emitting diode driving apparatus has the serial light emitting diode line DL1 (first serial light emitting diode line) connected to the other end of the second winding of the current distribution coil BC2 via the rectifier diode D1 (first rectifier diode). The light emitting diode driving apparatus has the serial light emitting diode line DL2 (second serial light emitting diode line) connected to the other end of the first winding of the current distribution coil BC2 via the rectifier diode D2 (second rectifier diode). The light emitting diode driving apparatus has the serial light emitting diode line DL3 (third serial light emitting diode line) connected to the other end of the first winding of the current distribution coil BC4 via the rectifier diode D3 (third rectifier diode).

Figure 6:
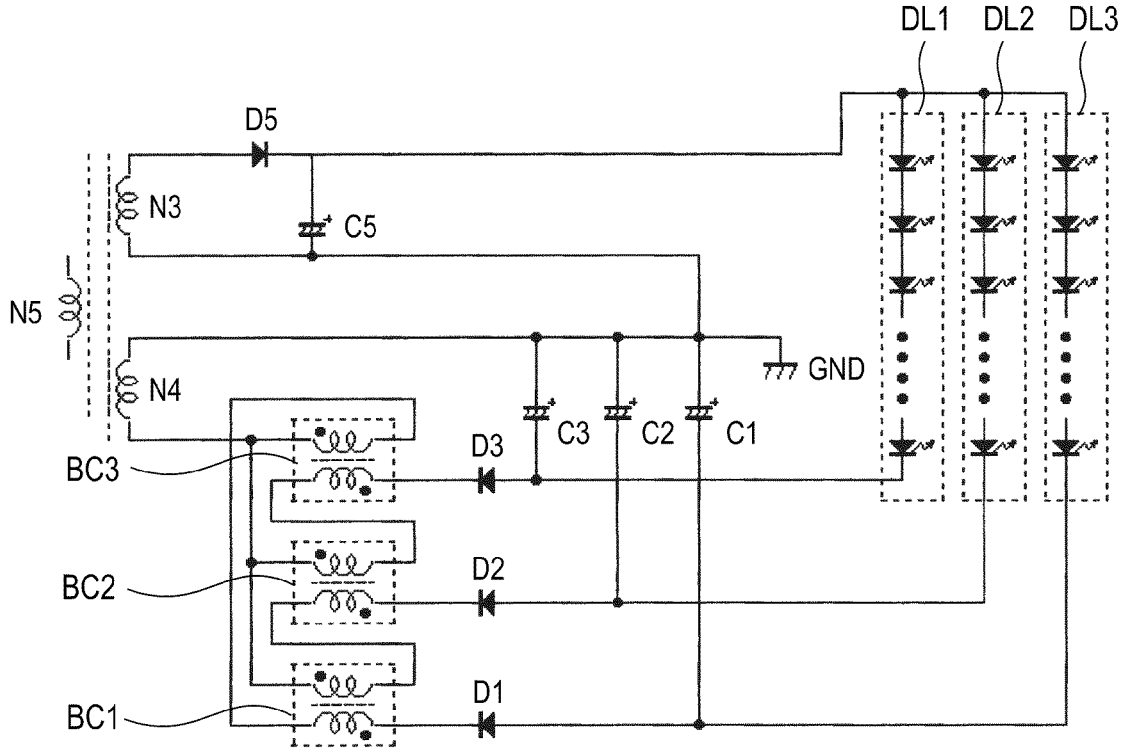
FIG. 6 is a diagram showing a light emitting diode driving apparatus according to a sixth embodiment which drives a first serial light emitting diode line, a second serial light emitting diode line and a third serial light emitting diode line.

FIG. 6 is a diagram showing the essential portions of a light emitting diode driving apparatus according to the sixth embodiment which drives a first serial light emitting diode line, a second serial light emitting diode line and a third serial light emitting diode line. The circuit shown in FIG. 6 has a current distribution circuit provided on a negative power source side, and has a power source with no distribution provided on the positive side. The current distribution to the first to third serial light emitting diode lines is carried out by the distribution circuit provided on the negative side. Referring to FIG. 6, the sixth embodiment is described.

As shown in FIG. 6, the current distribution coils BC1 to BC3 have the same structures as the structure of the current distribution coil BC according to the first embodiment. The mode of connection of the current distribution coils BC1 to BC3 is similar to that of the third embodiment. Since the current distribution coils BC1 to BC3 are provided on the negative-voltage power source side, however, the start of turning of the second winding of the current distribution coil BC1 is connected to the cathode of the rectifier diode D1, the start of turning of the second winding of the current distribution coil BC2 is connected to the cathode of the rectifier diode D2, and the start of turning of the second winding of the current distribution coil BC3 is connected to the cathode of the rectifier diode D3. Meanwhile, the start points of turning of the first windings of the current distribution coils BC1 to BC3 are connected together to one end of a winding N4. A winding N5, a winding N3 and the winding N4 are wound on the same core, and AC power supplied from the winding N5 is acquired from the winding N3 and the winding N4.

The anode of a rectifier diode D5 is connected to one end of the winding N3, and the cathode of the rectifier diode D5 is connected with the positive terminal of a capacitor C5 whose negative terminal is connected to the other end of the winding N3. Then, a DC voltage is produced across the capacitor C5. The positive terminal of the capacitor C5 is connected to the anode sides of the first to third serial light emitting diode lines. The cathode side of the first serial light emitting diode line is connected to the anode of the rectifier diode D1, the cathode side of the second serial light emitting diode line is connected to the anode of the rectifier diode D2, and the cathode side of the third serial light emitting diode line is connected to the anode of the rectifier diode D3. The capacitor C1 is connected between the other end of the winding N4 and the anode of the rectifier diode D1, the capacitor C2 is connected between the other end of the winding N4 and the anode of the rectifier diode D2, and the capacitor C3 is connected between the other end of the winding N4 and the anode of the rectifier diode D3.

The actions of the current distribution coils BC1 to BC3, like those of the third embodiment, allow equal currents to flow to the rectifier diodes D1 to D3. This can make the amounts of the currents flowing to the first to third serial light emitting diode lines equal to each other.

That is, the sixth embodiment employs the mode of connection of the current distribution coils BC1 to BC3 which is similar to that of the third embodiment. The sixth embodiment however differs from the third embodiment in that the polarities of the rectifier diodes D1 to D3 and the polarities of the capacitors C1 to C3 are reversed. The anode of the serial light emitting diode line DL1 (first serial light emitting diode line), the anode of the serial light emitting diode line DL2 (second serial light emitting diode line), and the anode of the serial light emitting diode line DL3 (third serial light emitting diode line) are connected to one another, and the node of connection of the anodes is connected with a voltage source which generates a voltage whose polarity is the opposite to the polarity of the voltage at the node between each of the rectifier diodes D1 to D3 and the respective one of the capacitors C1 to C3. The voltage source is obtained by rectification and smoothing of power from the winding N3 with the rectifier diode D5 and the capacitor C5.

Figure 7:
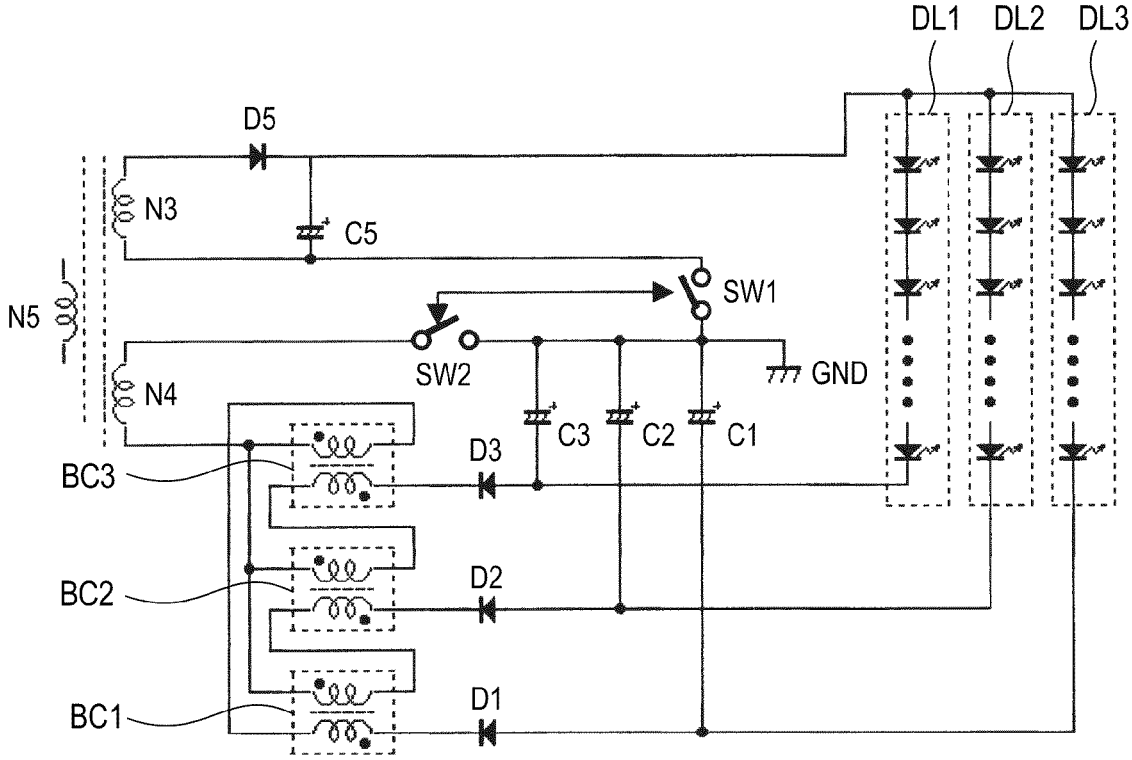
FIG. 7 is a diagram showing a light emitting diode driving apparatus having switches for pulse width modulation (PWM) light control.

FIG. 7 is a diagram showing a light emitting diode driving apparatus according to the seventh embodiment which has switches for pulse width modulation (PWM) light control. The circuit shown in FIG. 7 has a switch SW1 for PWM light control and a switch SW2 which operates in synchronism with the switch SW1. That is, when the PWM light control switch SW1 is in a conductive (ON) state, the switch SW2 is in a conductive (ON) state, whereas when the PWM light control switch SW1 is in a switch-off (OFF) state, the switch SW2 is in a switch-off (OFF) state. Such control can make the amount of the currents flowing in the first to third serial light emitting diode lines greater as the conductive (ON) state of the PWM light control switch SW1 is longer (as the duty ratio in the ON state is greater). In addition, when the PWM light control switch SW1 is in the switch-off (OFF) state, the switch SW2 is set in the switch-off (OFF) state to cut off the paths along which the currents flow to the capacitors C1 to C3.

To ensure such an operation, as shown in FIG. 7, the switch SW1 is connected between the node between the winding N3 and the capacitor C5 and the ground (GND), and the switch SW2 is connected between the winding N4 and the node of connection (which is also the ground) of the capacitors C1, C2 and C3.

The duty ratio of the conduction (ON) of the switch SW1 is controlled in this manner to ensure adjustment of the level of the current flowing in each of the first to third serial light emitting diode lines while making the currents flowing thereto equal to each other. With the PWM light control switch SW1 in the switch-off (OFF) state, the current distribution circuit is disconnected from the winding N4 at the OFF time where each light emitting diode does not emit light, preventing unnecessary charging of the capacitors C1 to C4 and thus achieving stable current distribution.

That is, the seventh embodiment has the switch SW1 and the switch SW2 in addition to the configuration of the sixth embodiment. The switch SW1 (first switch) is configured to control the duty ratio for supplying power to the serial light emitting diode line DL1 (first serial light emitting diode line), the serial light emitting diode line DL2 (second serial light emitting diode line) and the serial light emitting diode line DL3 (third serial light emitting diode line) from the positive voltage source. The switch SW2 (second switch) operates to simultaneously become conductive in synchronism with the switch SW1. Then, the switch SW2 is disposed between the switching converter and one end of the first winding of the current distribution coil BC1 (first current distribution coil), one end of the first winding of the current distribution coil BC2 (second current distribution coil) and one end of the first winding of the current distribution coil BC3 (third current distribution coil), and the ground.

According to the light emitting diode driving apparatuses according to the embodiments, one drive circuit can drive multiple light emitting diodes, thus making it possible to reduce the cost, the space and the number of components. Even if the forward bias voltages (voltage Vf) of the light emitting diodes vary, it is not unnecessary to perform a work of selecting light emitting diodes for the voltage Vf, which contributes to achieving stable current distribution of the light emitting diodes and cost reduction.

The present application contains subject matter related to that disclosed in Japanese Priority Patent Application JP 2008-208697 filed in the Japan Patent Office on Aug. 13, 2008, the entire contents of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A light emitting diode driving apparatus, comprising:

a switching converter having an inductor and a switching device;

a plurality of serial light emitting diode lines each having a plurality of light emitting diodes connected in series;

a plurality of rectifier diodes respectively connected in series to the plurality of serial light emitting diode lines;

a plurality of capacitors respectively connected to nodes between the serial light emitting diode lines and the rectifier diodes for smoothing a voltage;

at least three current distribution coils in which one end of the first winding of a first current distribution coil, one end of the first winding of a second current distribution coil, and one end of the first winding of a third current distribution coil are connected to the switching converter, an other end of the first winding of the first current distribution coil is connected to one end of the second winding of the second current distribution coil, an other end of the first winding of the second current distribution coil is connected to one end of the second winding of the third current distribution coil, and an other end of the first winding of the third current distribution coil is connected to one end of the second winding of the first current distribution coil;

wherein the plurality of serial light emitting diode lines comprise:

a first serial light emitting diode line connected to an other end of the second winding of the first current distribution coil via a first rectifier diode;

a second serial light emitting diode line connected to an other end of the second winding of the second current distribution coil via a second rectifier diode; and a third serial light emitting diode line connected to an other end of the second winding of the third current distribution coil via a third rectifier diode.

2. The light emitting diode driving apparatus according to claim 1, wherein the side of the first serial light emitting diode line which is not connected to the first rectifier diode, the side of the second serial light emitting diode line which is not connected to the second rectifier diode, and the side of the third serial light emitting diode line which is not connected to the third rectifier diode are connected to one another, and a node at which the first serial light emitting diode line, the second serial light emitting diode line and the third serial light emitting diode line are connected together is connected with a voltage source which generates a voltage of a different polarity from polarities of a voltage at a node between the first rectifier diode and the first serial light emitting diode line, a voltage at a node between the second rectifier diode and the second serial light emitting diode line, and a voltage at a node between the third rectifier diode and the third serial light emitting diode line.

3. The light emitting diode driving apparatus according to claim 2, further comprising:

a first switch that controls a duty ratio for supplying power to the first serial light emitting diode line, the second serial light emitting diode line and the third serial light emitting diode line from the voltage source; and a second switch whose duty ratio at a conduction time is controlled in synchronism with the first switch, the second switch being provided between the switching converter and the one end of the first winding of the first current distribution coil, the one end of the first winding of the second current distribution coil, and the one end of the first winding of the third current distribution coil.

* * * * *